US005507224A

United States Patent [19]

Cuff

[11] Patent Number: 5,507,224

[45] Date of Patent: Apr. 16, 1996

[54] PAPER DECK POWER LIFTER KIT FOR RETROFITTING A MANUALLY CRANKED OFFSET PRINTING PRESS

[76] Inventor: Corby S. Cuff, 609 Queens Avenue, New Westminster, B.C., Canada, V3M 1L1

[21] Appl. No.: 155,792

[22] Filed: Nov. 23, 1993

[51] Int. Cl.[6] ..... B41F 7/02; B65H 1/18

[52] U.S. Cl. ..... 101/232; 271/155

[58] Field of Search ..... 271/155, 157; 101/217, 218, 232

[56] References Cited

U.S. PATENT DOCUMENTS

| | | | |
|---|---|---|---|
| 3,820,777 | 6/1974 | Reehil | 271/153 |
| 4,801,135 | 1/1989 | Porio | 271/157 |
| 4,832,329 | 5/1989 | Radi | 271/155 |
| 5,157,448 | 10/1992 | Lang | 271/157 |
| 5,201,509 | 4/1993 | Kirchoft | 271/157 |
| 5,248,137 | 9/1993 | Rabjohns | 271/157 |

OTHER PUBLICATIONS

J. C. Whitney Catalog pp. 1 and 27 1982.

*Primary Examiner*—Edgar S. Burr
*Assistant Examiner*—Steven S. Kelley
*Attorney, Agent, or Firm*—Oyen Wiggs Green & Mutala

[57] ABSTRACT

This invention relates to a novel power lifter for a paper deck of an offset printing press. A paper deck power lifter for an offset printing press comprising: (a) a reversible electric motor connected to a paper deck elevation crankshaft of an offset printing press; (b) an electrically activated solenoid connected to a paper deck catch release of an offset printing press; (c) a manually operated polarity reversing switch connected to the electric motor for determining the direction of electrical current to be delivered to the electrical motor, thereby selecting the direction of rotation of the electric motor; (d) a manually activated electrical variable speed switch electrically connected to the electric motor to enable manual control of the speed of rotation of the electric motor.

7 Claims, 6 Drawing Sheets

PAPER DECK POWER LIFTER KIT FOR RETROFITTING A MANUALLY CRANKED OFFSET PRINTING PRESS

FIELD OF THE INVENTION

This invention relates to a novel power lifter for the paper deck of an offset printing press. More specifically, this invention pertains to novel apparatus which can be used to control manually a power source which can be turned on or off in order to automatically raise or lower a paper deck of an offset printing press.

BACKGROUND OF THE INVENTION

In conventional offset printing presses, such as the 9000 series manufactured by AB Dick Corporation, the paper deck which is located at one end and which acts as a magazine, upon which stacks of unprinted paper are loaded, must be manually handle wound up or down in elevation according to the number of sheets of paper that are to be printed. To manually handle wind down a paper deck on such an offset press, from the maximum top elevation, where all the unprinted paper has been exhausted, to the maximum bottom position, upon which the maximum height of paper can be stacked, may require fifty or more turns on a manual handle at the side of the press.

In operation, the paper deck is loaded with a stack of blank paper to be printed and the handle is wound to set the elevation of the paper deck to accommodate the given number of sheets to be printed. The offset press then begins to print the sheets of paper in turn and automatically raises the elevation of the paper deck, as each sheet of paper is withdrawn in series from the stack of paper on the paper deck. The elevation of the paper deck gradually rises, until it reaches a maximum height elevation, at which point the stack of unprinted paper is exhausted. A catch release, located on the side of the offset printing press, must then be tripped manually in order to enable the printing press operator to manually handle wind down the elevation of the paper deck and thereby restore it to a position for loading another stack of paper to be printed.

Manually winding up or down the elevation of the paper deck, by turning a manual crank, is time consuming and labour intensive.

SUMMARY OF THE INVENTION

This invention relates to a power lifter for the paper deck of an offset printing press. More specifically, this invention pertains to novel apparatus which can be used to control manually a power source which can be turned on or off in order to automatically raise or lower a paper deck of an offset printing press.

The invention is directed to a paper deck power lifter for an offset printing press comprising: (a) a reversible electric motor connected by mechanical advantage transmission means to a paper deck elevation crankshaft of an offset printing press; (b) an electrically activated solenoid connected to a paper deck catch release of an offset printing press; (c) a manually operated electrical reversing switch connected to the reversible electric motor; (d) a manually activated electrical variable speed switch electrically connected to the electric motor to enable manual control of the speed of rotation of the electric motor.

The reversible electric motor of the power lifter can be a high torque electric motor connected to the paper deck elevation crankshaft.

The power lifter can include stops or bumpers which prevent the power lifter from raising the paper deck so high that it collides with the top of the press above the paper deck.

DRAWINGS

In drawings which illustrate specific embodiments of the invention, but which should not be construed as restricting or limiting the spirit or scope of the invention in any way:

DETAILED DESCRIPTION OF SPECIFIC EMBODIMENTS OF THE INVENTION

Figure 1:
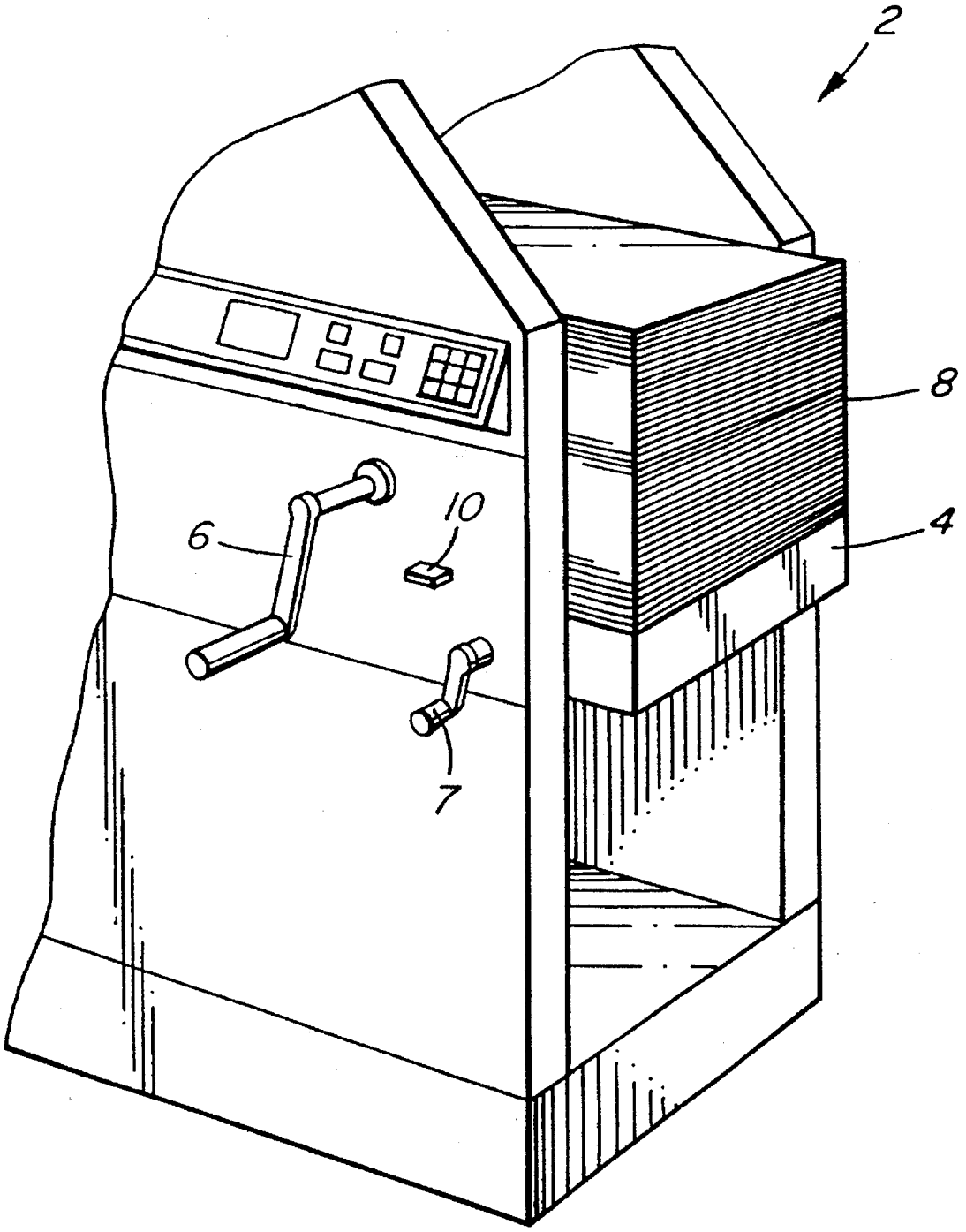
FIG. 1 illustrates an isometric view of a conventional offset printing press with manually adjustable paper deck elevation.

FIG. 1 illustrates an isometric view of a conventional ABDick, 9000 series™, offset printing press with a manual crank for raising or lowering the elevation of a paper deck. Specifically, as illustrated in FIG. 1, the offset press 2 has, at one end thereof, a paper deck 4, upon which a stack of unprinted paper 8 is placed. As the offset press 2 prints each sheet of paper, the deck 4 rises incrementally and the press withdraws individual sheets of paper from the top of the stack of paper 8. Specifically, as each sheet of paper is withdrawn automatically by the offset press 2, the elevation of the paper deck 4 automatically rises. When all the paper in the stack 8 has been exhausted, the paper deck 4 has risen to the top of its travel.

In order to reload the offset press 2, and return the deck 4 to a lower position, the catch release 10 on the side of the offset press 2 must be manually tripped. At that time, it is then possible to lower the elevation of the paper deck 4 to the desired elevation to receive a fresh stack of printing paper 8 according to the job order. This is done by manually cranking paper deck crank 6, either in a clock-wise or counter clock-wise direction, which through a series of gears and chains in the interior of the press 2, lowers the elevation of the paper deck 4. Numerous turns of the crank 6 are required in order to lower the paper deck 4 to its desired lowest elevation. The elevation of the paper deck 4 can, of course, be raised to a desired location by manually turning the crank 6. This manual cranking procedure is slow and labour intensive.

Figure 2:
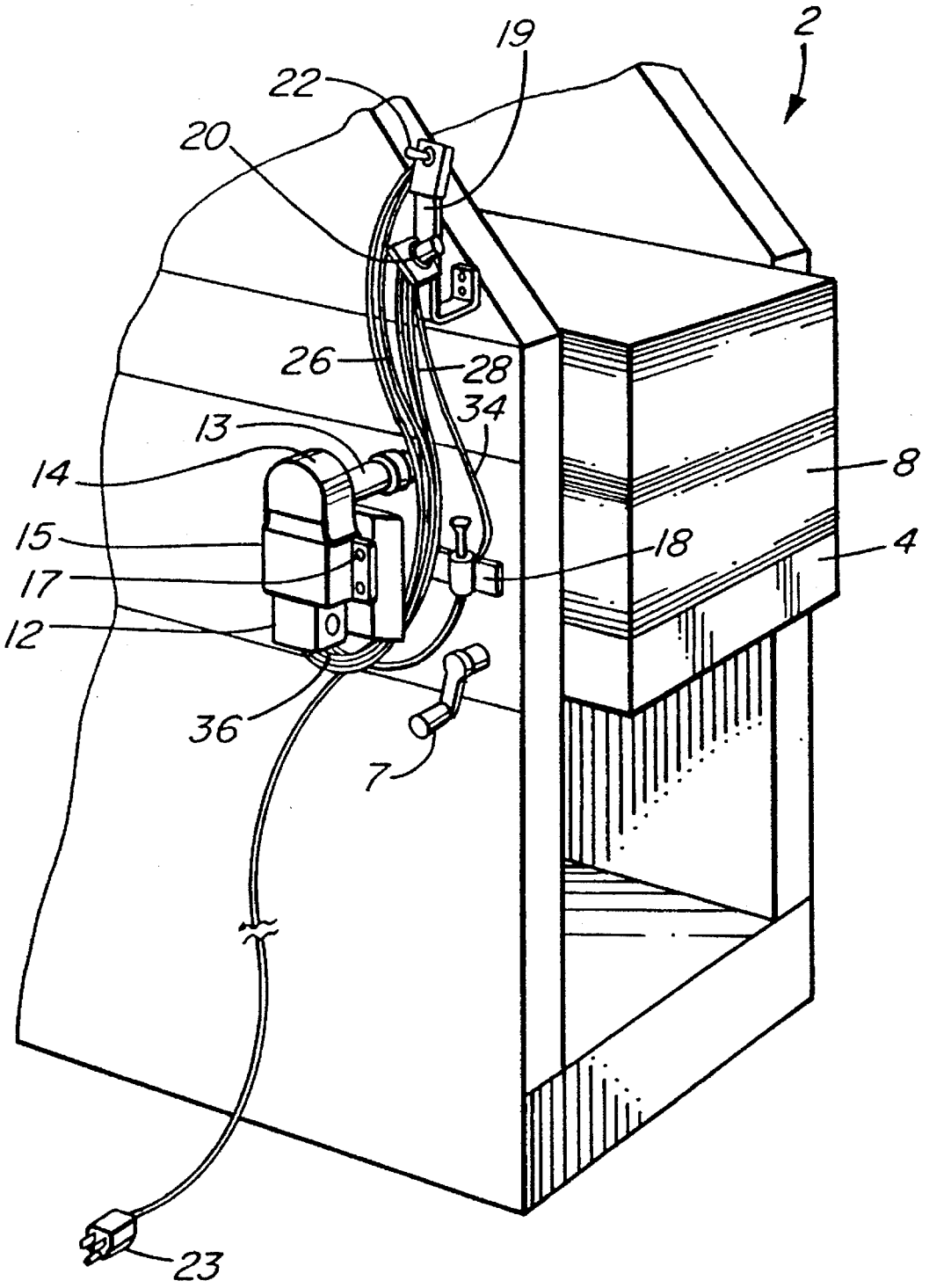
FIG. 2 illustrates an isometric view of an offset printing press retrofitted with the power driven paper deck lifter according to the invention.
Figure 3:
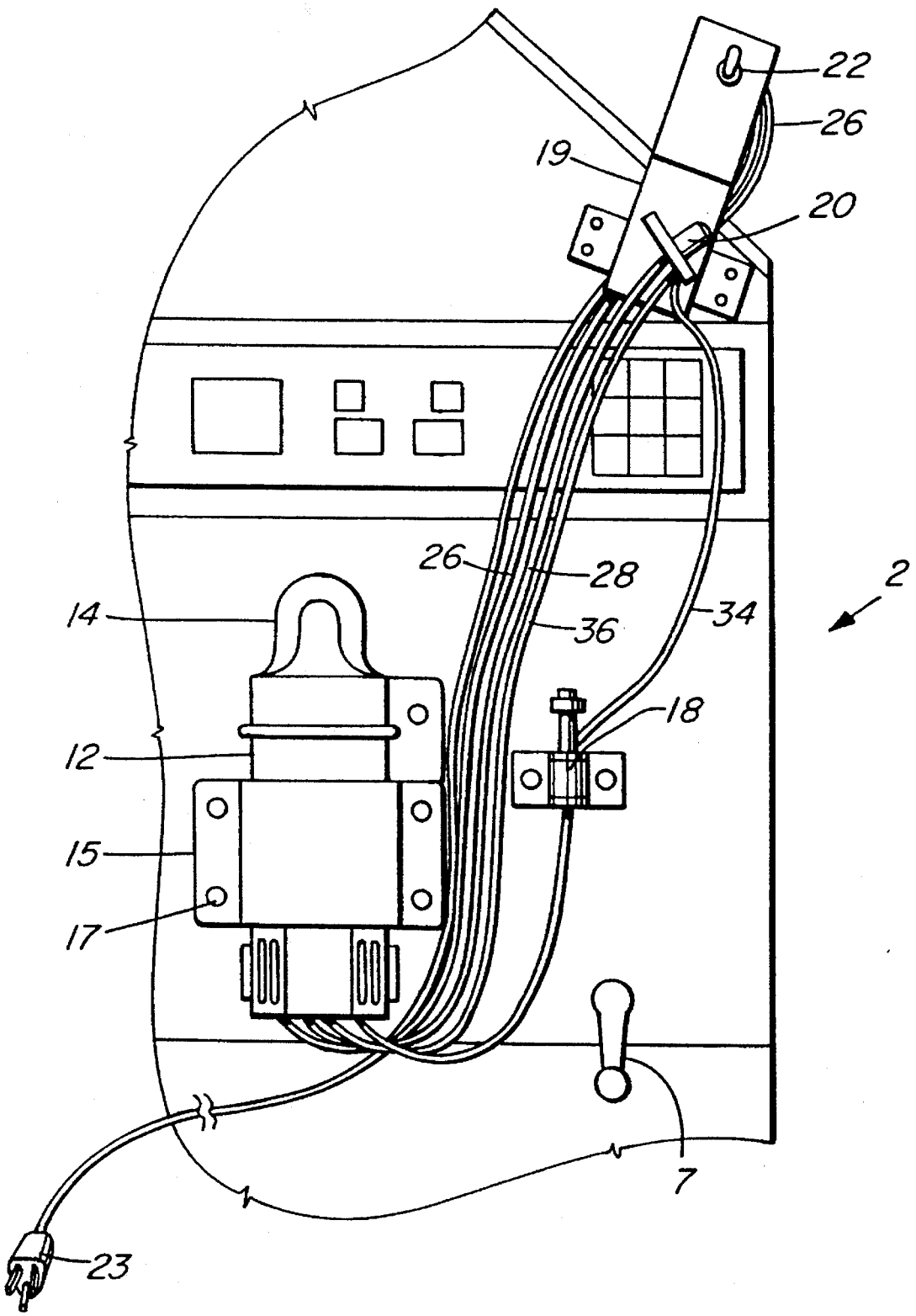
FIG. 3 illustrates a side elevation view of an offset printing press retrofitted with the paper deck power lifter.
Figure 5:
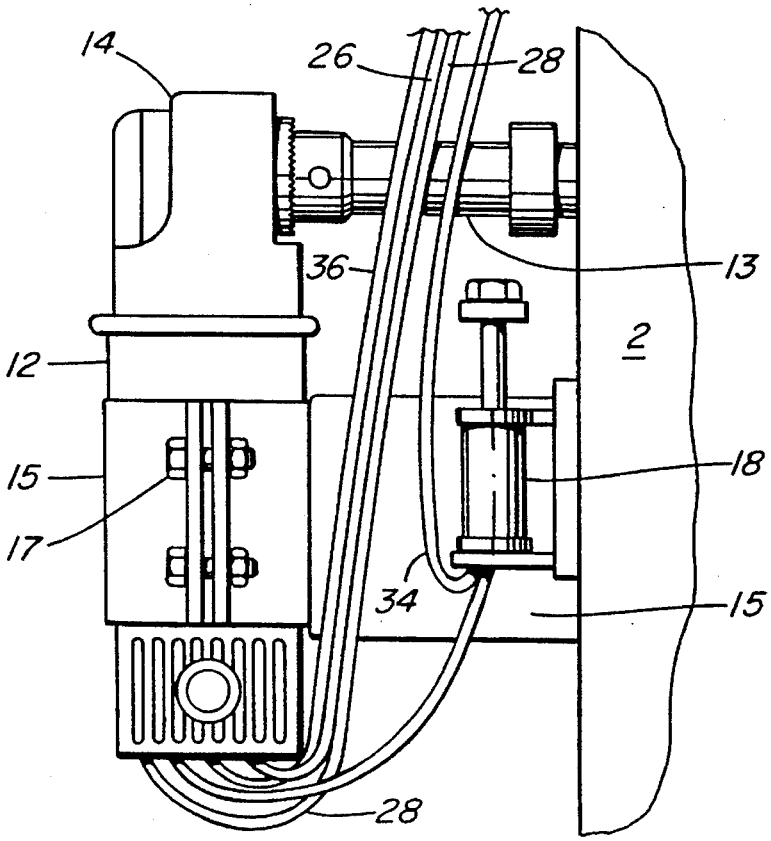
FIG. 5 illustrates an end view of a sidewinder electrical motor solenoid catch release and reversing switch adapted to power raise or lower the elevation of a paper deck.

FIG. 2 illustrates an isometric view of a conventional offset press retrofitted with a prototype of the paper deck power lifter according to the invention. The power lifter prototype comprises, in combination, an electrical motor 12, with a right angle transmission 14, which is connected to the paper deck crank shaft 13 of the offset printing press 2, to which the crank 6 is normally connected, but has been removed. The motor 12 is secured in place to the side of the press 2 by motor holder 15 and bolts 17. As illustrated in FIGS. 2, 3 and 5 the electrical motor 12 used in the prototype of the invention is an electrical motor manufactured by Makita, Inc., and sold under the trade-mark MAKITA ⅜ right angle drill.

Positioned immediately beside the electrical motor 12 and electrically wired to the polarity reversing switch 20 is a solenoid catch release 18. This solenoid powered catch release 18 is connected to the standard catch release 10 (see FIG. 1), and when the solenoid is activated, trips the catch release 18 so that the paper deck 4 can be lowered from its uppermost position to a lower elevation.

Connected to the upper side of the printing press 2, immediately adjacent the paper stack 8, and mounted on a brace 19 is a polarity reversing switch 20, which is manually controlled, from an "up" position to a "down" position, or vice versa, and an electrical variable speed switch 22, which is also manually controlled. The polarity reversing switch 20 is electrically connected to the electrical motor 12. The manually activated variable speed switch 22 is electrically connected to the electrical motor 12, and stops and starts the motor 12. The reversing switch 20 is of a type commonly available on the market, and regulates or controls the direction of rotation of the electrical motor 12. A suitable reversing switch 20 is a two position Lithrow rotary switch sold under the trademark LORLIN-UK.

In this way, the deck 4 can be raised or lowered as required. The electrical motor 12 can be any conventional high mechanical advantage electrical motor with a right angle transmission, available on the market.

Figure 7:
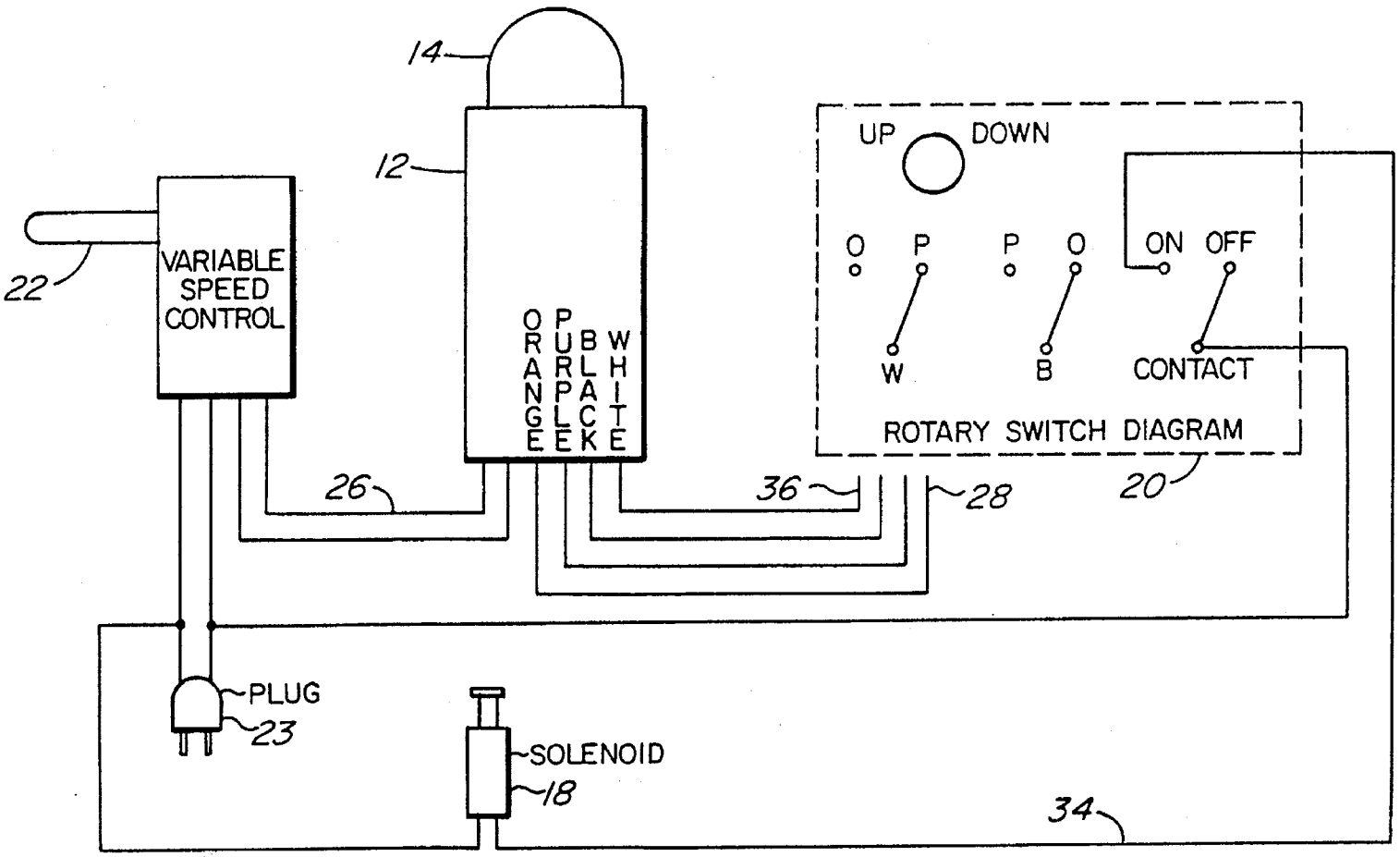
FIG. 7 illustrates a wiring circuit diagram for the power lifter.

The electrical motor 12 is retrofittedly connected by right angle transmission 14, to the crank 13 which, through a system of gears and chains, winds upwardly or downwardly the elevation of the paper deck 4. Depending upon the position of the manually controlled polarity reversing switch 20, activation of the electrical motor 12 via right angle transmission 14 may either rotate the crank connection 13 clockwise or counterclockwise and consequently raise or lower the elevation of the paper deck 4. In other words, when the polarity reversing switch 20 is manually placed in a first position, the electrical wiring connections shown in more detail in FIG. 5 and illustrated in FIG. 7 are such that the electrical motor 12 rotates in a certain direction, for example clock-wise, and correspondingly raises or lowers the paper deck 4, according to the direction of the electrical current. Placing the switch 20 in the opposite position reverses the procedure. If the polarity reversing switch 20 is in a position where activation of the manual variable speed switch 22 will cause the paper deck 4 to rise, when in fact the operator wants the elevation of the paper deck 4 to descend, the operator simply reverses the position of the polarity reversing switch 20. The polarity reversing switch 20 is clearly marked so that the operator will know whether the switch 20 is in a "up" or "down" position.

The manual variable speed switch 22 is of a type commonly available on the marketplace (for example, Makita Inc. manufactures and sells a variable speed switch) and controls the amount of electrical current that is transmitted from a standard power source, such as a standard AC outlet, to the electrical motor 12. Depressing the variable speed switch 22 only slightly, will cause the electrical motor 12 to rotate at a slow rate. Thus, the paper deck will descend or rise at a slow rate. If the operator moves the manual variable speed switch 22 to a more extreme position, more electrical current will be delivered to the electrical motor 12, and accordingly the motor 12 will rotate at a higher revolutions per minute rate, and thus correspondingly the paper deck 4 will rise or descend at an accelerated speed.

FIG. 3 illustrates an enlarged side elevation view of an offset printing press retrofitted with the paper deck power lifter. FIG. 3 illustrates in detail the manner in which the electrical motor 12 is connected by a right angle transmission 14 to the crank shaft (not shown but see FIG. 2) of the manual crank, which is standard equipment on a convention offset printing press 2. Variable speed switch 22 and reversing switch 20 are mounted on the press 2 by brace 19. As seen in FIG. 3, the touch switch 22 is electrically connected by wiring 26 to electrical motor 12. Further, electrical wiring 28 connects the polarity reversing switch 20 with the electrical motor 12.

FIG. 3 also illustrates the motor 12, and solenoid 18 mounted on the side of the press 2. The motor 12 is mounted by motor holder 15 and holder bolts 17 to the side of the press 2. Connecting wires 26 and 28 link the variable speed switch 22 and polarity reversing switch 20 to the motor 12. A wire 30 connects the solenoid 18 to the reversing switch 20.

Figure 4:
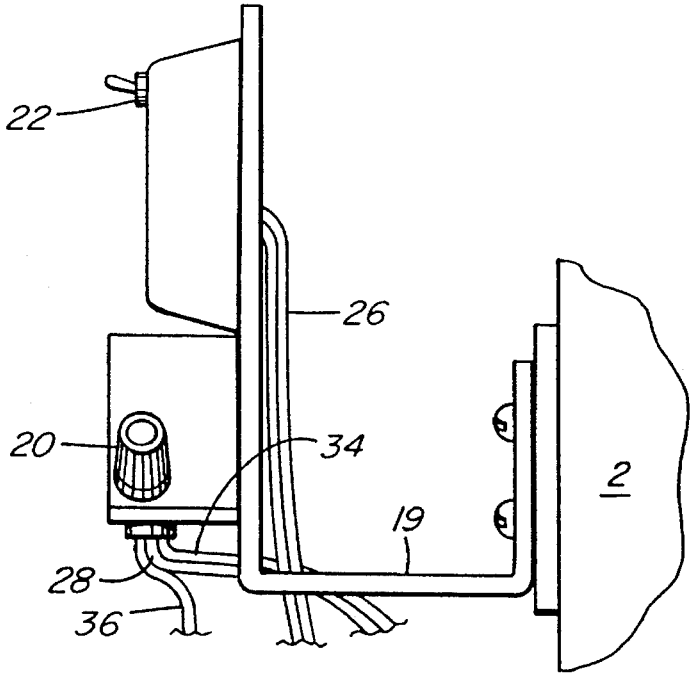
FIG. 4 illustrates an end view of a manual variable speed electronic control switch and a polarity reversing switch, together with mounting brace.

FIG. 4 illustrates a detailed end view of the manual electronic variable speed control switch 22 and polarity reversing switch 20, together with mounting brace 19. The manually operated switch 22, and the polarity reversing switch 20, are mounted on the brace 19, at a raised elevation, which is readily visible and handy to the printing press operator. The operator therefore does not need to bend down in order to operate either the polarity reversing switch 20, or the manual variable speed switch 22.

FIG. 5 illustrates a detailed end view of an electrical motor 12 adapted to raise or lower the elevation of a paper deck. FIG. 5 also illustrates in detail the motor 12 mounted by holder 15 and bolts 17 to press 2. The manner in which right angle transmission 14 is connected to crank 13 is clearly visible. The wires 26 and 28 which come down from variable speed switch 22 and reversing switch 20 (not seen in FIG. 5) are connected to the motor 12. Solenoid 18 is mounted separately to the side of press 2. As seen in FIG. 5, the electrical reversing switch 20 is also connected by wire 34 to the solenoid catch release 18, thereby enabling the solenoid catch release 18 to be activated when the reversing switch 20 is turned to the "down" position. This enables the paper deck 4 to be electrically powered to a lower elevation by the electrical motor 12, the direction of which has been reversed by the reversing switch 20.

Figure 6:
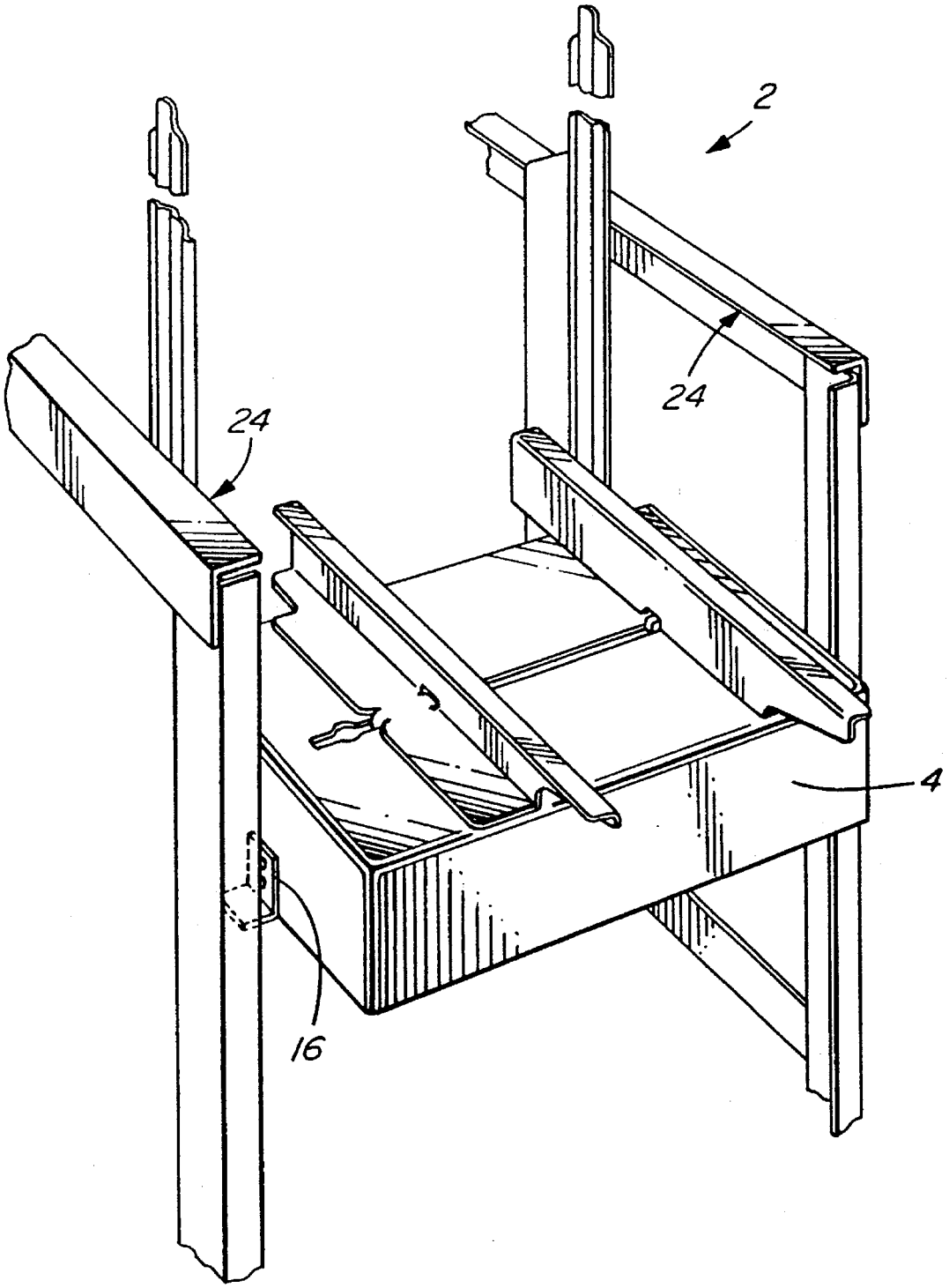
FIG. 6 illustrates an isometric view of the paper deck and printing press equipped with stops which prevent the paper deck raising beyond a predetermined point.

FIG. 6 illustrates an isometric view of the paper deck and printing press equipped with stops which prevent the paper deck raising beyond a determined point. The paper deck 4 has a pair of stops 16 on either side, which contacts physically the underside of a rail that is part of the offset printing press 2. These stops 16 prevent the paper deck 4 from being inadvertently raised beyond a desired elevation and thus causing damage to the deck 4 or the press 2.

FIG. 7 illustrates a wiring circuit diagram for the power lifter. As indicated in FIG. 7, standard orange, purple, black and white wires connect to the motor 12. The rotary switch 20 contact diagram illustrates the orange, purple, black and white contact points. Connection by rotary switch 20 of white to purple and black to orange causes the motor 12 to rotate clockwise. Moving switch 20 so that it causes connection between orange and white, and purple and black causes the motor 12 to rotate counterclockwise.

Process of Operation

When the prototype of the power lifter has been retrofitted to the offset press, and an operator wishes to print a given number of sheets of paper, the operator will, as is conventional, place a standard stack of unprinted paper 8 on the paper deck 4. However, before doing so, the operator will power adjust the elevation of the paper deck 4 by placing the polarity reversing switch 20 in the appropriate position, either up or down, and manually activate variable speed switch 22 to thereby cause the electrical motor 12 to rotate at an appropriate speed, and in an appropriate direction, to thereby raise or lower the elevation of the paper deck 4 to correspond with the height of the stack of paper 8 to be printed. Fine adjustments in elevation of the paper deck 4 can be readily controlled by manually and sensitively activating variable speed switch 22.

After the offset press 2 has printed all sheets and has exhausted the stack of paper 8, the paper deck 4 reaches the top of its travel. Stops 16 and 24 prevent the paper deck 4 from being raised too high. At this time the operator turns the reversing switch 20 to the "down" position. This activates the solenoid 18 and thereby enables the paper deck 4 to be lowered to a specified lower elevation for receiving a fresh stack of paper 8 to be printed. By utilizing the invention, the operator can quickly and with a minimum of manual labour, adjust the elevation of the paper deck 4 to receive quickly a fresh stack of paper 8, of a specified thickness, according to the printing job to be handled by the offset press 2.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A paper deck variable speed power lifter kit for retrofitting a manually cranked offset printing press, said kit comprising:

(a) a reversible electric motor connectable to a paper deck elevation crankshaft of a manually cranked offset printing press;

(b) an electrically activated solenoid connectable to a paper deck catch release of a manually cranked offset printing press;

(c) a manually operated polarity reversing switch electrically connected to the electric motor for determining the direction of electrical current to be delivered to the electric motor, thereby selecting the direction of rotation of the electric motor and thereby selecting the direction of vertical movement of the paper deck of a manually cranked offset printing press; and (d) a manually activated electrical variable speed switch electrically connected to the electric motor to enable vertical positioning of the paper deck at any elevation and manual control of the speed of rotation of the electric motor, thereby enabling manual control of the elevation and speed of vertical movement of the paper deck of a manually cranked offset printing press.

2. A power lifter kit as claimed in claim 1 wherein the reversible electric motor is a high torque electric motor.

3. A power lifter kit as claimed in claim 2 wherein the electric motor is connectable to the paper deck elevation crankshaft by a high mechanical advantage transmission means.

4. A power lifter kit as claimed in claim 3 including stop means on the paper deck to prevent the paper deck from being elevated beyond a specific elevation.

5. A power lifter kit as claimed in claim 1 wherein the reversing switch activates the catch release when placed in a paper deck lowering position.

6. A power lifter kit as claimed in claim 1 wherein the variable speed switch is connected to an electrical power source.

7. A power lifter kit as claimed in claim 1 wherein said polarity reversing switch and said variable speed switch are mountable on a manually cranked offset printing press.

* * * * *